US006159031A

United States Patent [19]

Llapitan et al.

[11] Patent Number: 6,159,031

[45] Date of Patent: Dec. 12, 2000

[54] RETENTION MECHANISM THAT CAN BE USED WITH DIFFERENT ELECTRONIC ASSEMBLIES

[75] Inventors: David J. Llapitan, Puyallup; Michael Crocker, Tacoma; Peter Davison, Sumner, all of Wash.

[73] Assignee: Intel Corporation, Santa Clara, Calif.

[21] Appl. No.: 09/327,212

[22] Filed: Jun. 7, 1999

[51] Int. Cl.[7] ..... H01R 13/62

[52] U.S. Cl. ..... 439/326; 439/327

[58] Field of Search ..... 439/153, 357, 439/546, 547, 557, 575, 326, 327, 329, 377; 361/727, 658; 174/50, 51; 220/4.02

[56] References Cited

U.S. PATENT DOCUMENTS

| | | | |
|---|---|---|---|
| 3,932,016 | 1/1976 | Ammenheuser | 339/65 |
| 4,349,237 | 9/1982 | Cobaugh et al. | 339/65 |
| 4,785,379 | 11/1988 | Goodrich | 361/388 |
| 5,286,217 | 2/1994 | Liu et al. | 439/326 |
| 5,889,656 | 3/1999 | Yin | 361/801 |
| 5,892,659 | 4/1999 | Cooper et al. | 361/727 |

*Primary Examiner*—Paula Bradley
*Assistant Examiner*—Alexander Gilman
*Attorney, Agent, or Firm*—Blakely, Sokoloff, Taylor & Zafman LLP

[57] ABSTRACT

A retention mechanism for securing an electronic subassembly. The retention mechanism may include a latch that extends from a wall. The latch may extend into either a cover opening of a SECC type subassembly or a heat sink notch of a SEPP type subassembly.

9 Claims, 3 Drawing Sheets

RETENTION MECHANISM THAT CAN BE USED WITH DIFFERENT ELECTRONIC ASSEMBLIES

BACKGROUND OF THE INVENTION

1. Field of the Invention

The present invention relates to a retention mechanism that secures an electronic subassembly to a motherboard.

2. Background Information

Integrated circuits are typically assembled into packages that are mounted to a printed circuit board. The printed circuit board may be incorporated into an electronic subassembly that can be plugged into a motherboard. By way of example, Intel Corp., the assignee of the present invention, has sold an electronic subassembly that is referred to as a single edge contact cartridge (SECC). The SECC has a plurality of contact pads located along an edge of a printed circuit board. The contact pads can be inserted into an electrical connector that is mounted to a motherboard of a computer.

The computer may be subjected to external shock and vibration loads. An SECC type computer includes a retention system to secure the electronic subassembly and prevent separation between the contact pads and the connector during shock and vibration. The retention system includes a latch that extends from an opening in a cover of the subassembly. The latch extends into a corresponding opening of a retention mechanism that is mounted to the motherboard.

Intel Corp. has also sold an electronic subassembly that is referred to as a single edge processor package (SEPP). The SEPP is also provided with an accompanying retention mechanism that is coupled to a heat sink of the subassembly. The retention mechanism of the SEPP is different from the retention mechanism of the SECC. The different retention mechanisms increase the complexity of producing, storing and selling the parts. It would be desirable to provide a retention mechanism that can secure both an SECC and an SEPP electronic subassembly.

SUMMARY OF THE INVENTION

One embodiment of the present invention is a retention mechanism for securing an electronic subassembly. The retention mechanism may include a latch that extends from a wall.

DETAILED DESCRIPTION

Figure 1:
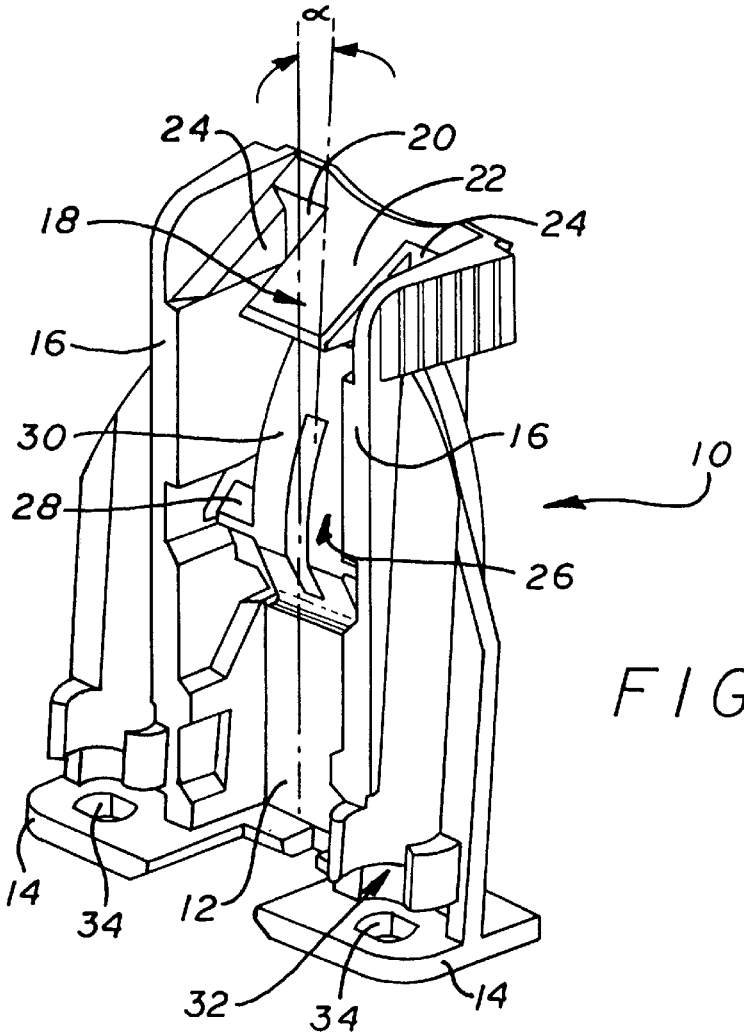
FIG. 1 is a front perspective view of an embodiment of a retention mechanism of the present invention.
Figure 2:
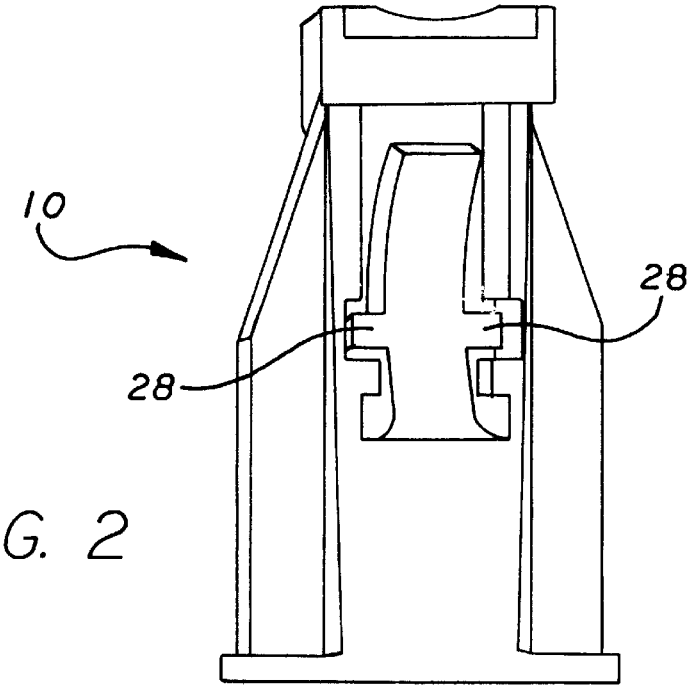
FIG. 2 is a rear perspective view of the retention mechanism.

Referring to the drawings more particularly by reference numbers, FIGS. 1 and 2 show an embodiment of a retention mechanism 10 of the present invention. The retention mechanism 10 may include a rear wall 12 that extends from a pair of feet 14 and a pair of side walls 16 that extend from the rear wall 12. The mechanism 10 may further have a latch 18 that extends from a top portion 20 of the rear wall 12. The latch 18 can be coupled to an electronic assembly (not shown). The latch 18 may have a tapered surface 22 and be separated from the side walls 16 by a pair of slots 24.

The rear wall 12 may have a spring portion 26 that has a pair of latches 28. The spring portion 26 may have a tapered surface 30 and be canted with respect to the rear wall 12 by an angle $\alpha$. By way of example, the angle $\alpha$ may be 3.2 degrees.

The retention mechanism 10 may include a pair of nut retainers 32 that extend from the side walls 16. The retainers 32 are located adjacent to apertures 34 in the feet 14.

Figure 3:
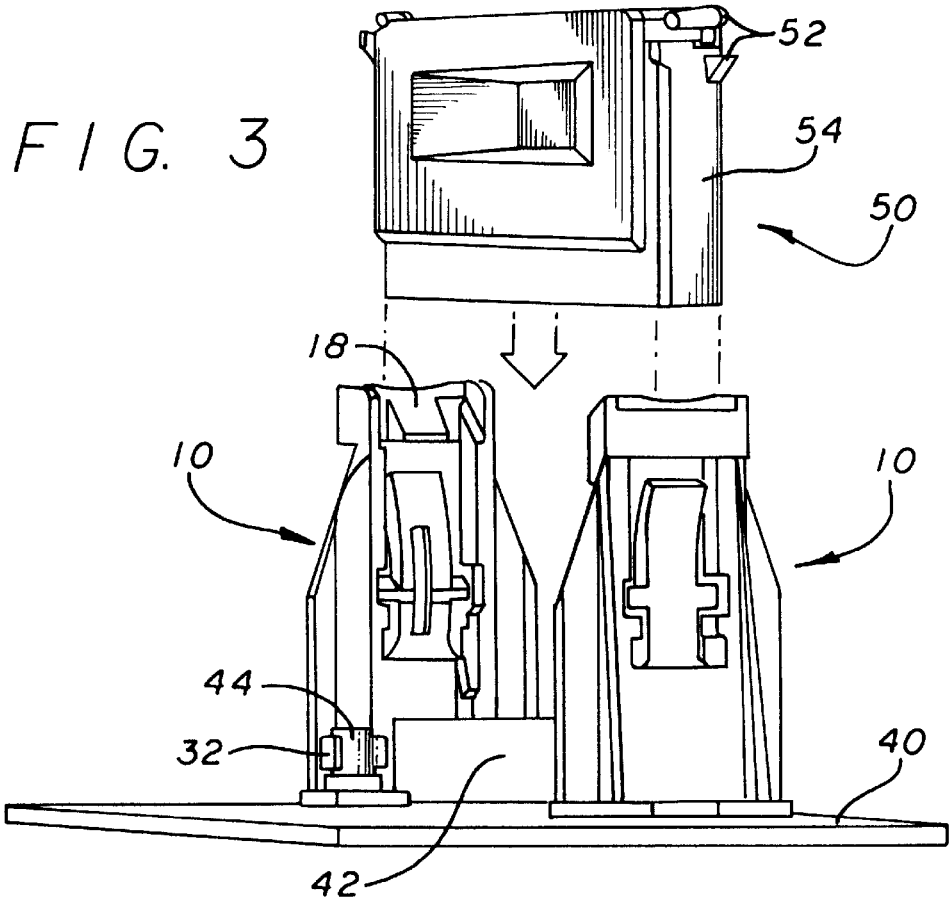
FIG. 3 is a perspective view showing the retention mechanism and a SECC type electronic subassembly.

As shown in FIG. 3, a pair of retention mechanisms 10 may be mounted to a motherboard 40 adjacent to a motherboard connector 42. Each mechanism 10 may be secured to the motherboard 40 by screws (not shown) that extend through the bottom of the board 40 and are attached to nuts 44 located within the retainers 32. The retainers 32, slots 24 and latch 18 are symmetric so that the same mechanism 10 can be mounted to either side of the connector 42. There is no requirement to have a left side mechanism or a right side mechanism.

The mechanisms 10 can secure an electronic subassembly 50 to the connector 42 and the motherboard 40. The subassembly 50 may be a product sold by Intel Corp. that is referred to as a single edge contact cartridge (SECC). The SECC may contain a microprocessor (not shown) that is assembled into a package (not shown) and mounted to a printed circuit board (not shown). The SECC subassembly 50 includes a latch 52 that is coupled to a cover 54. The latch 52 is typically coupled to a retention mechanism (not shown) of the prior art.

Figure 4:
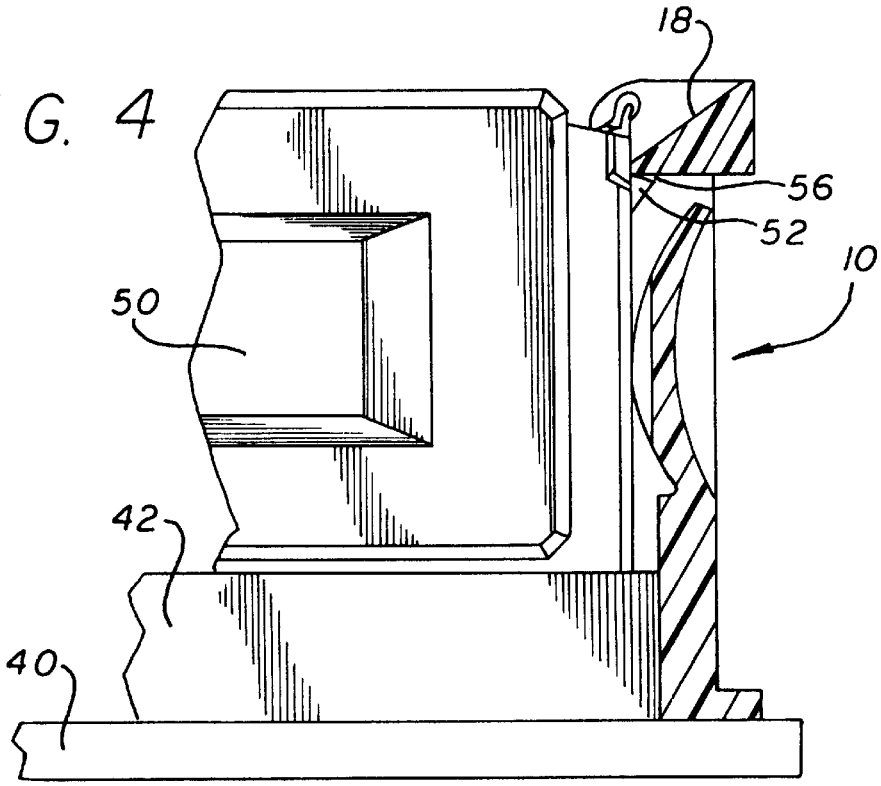
FIG. 4 is a perspective view showing the SECC subassembly secured by a retention mechanism.

The SECC subassembly 50 is plugged into the motherboard connector 42 by sliding the cover 54 between the side walls 16 of the retention mechanisms 10. The retention latches 18 will initially deflect the SECC latches 52 in an outward direction. The tapered surfaces 22 of the retention latches 18 assists in a smooth inward movement of the SECC latches 52. The latches 18 will snap back into the outward positions when the subassembly 50 is fully mated with the connector 42 as shown in FIG. 4. The SECC latches 52 engage the bottom surfaces 56 of the retention latches 18 to retain the subassembly 50. The spring portion 26 is also deflected to exert a spring force onto the cover 54 and further secure the subassembly 50 to the connector 42. The SECC subassembly 50 can be removed by pulling the SECC latches 52 into an inward locked position and then pulling the subassembly 50 out of the connector 42.

Figure 5:
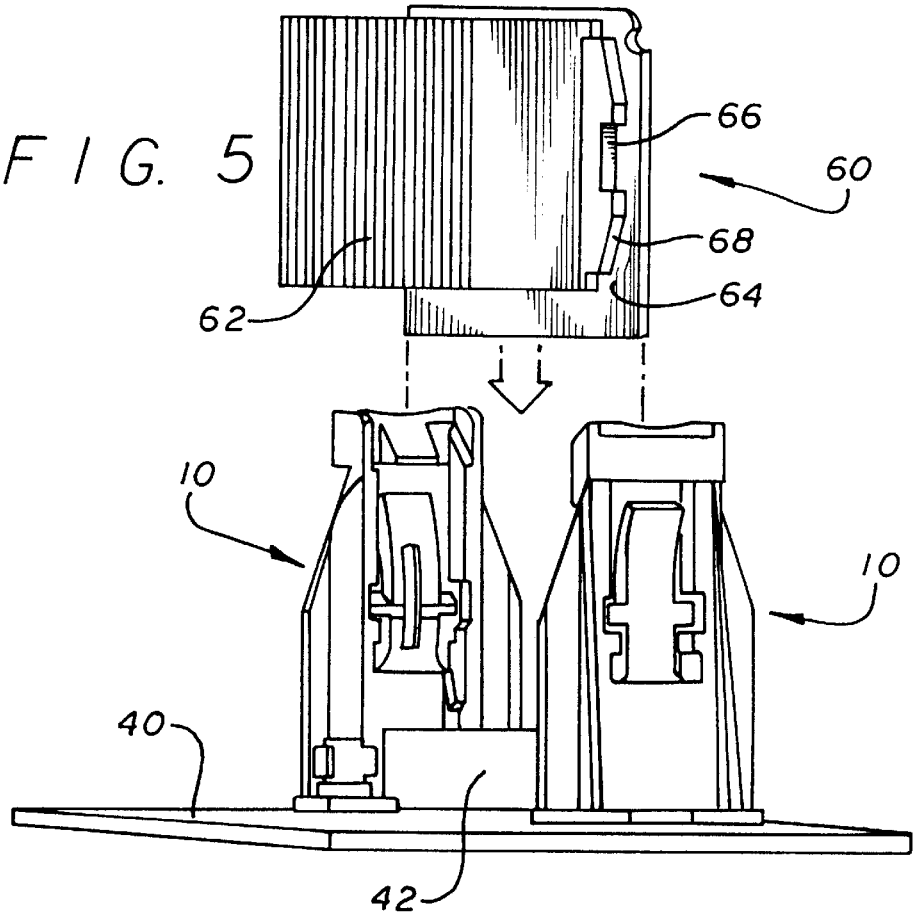
FIG. 5 is a perspective view showing the retention mechanism and a SEPP type electronic subassembly.
Figure 6:
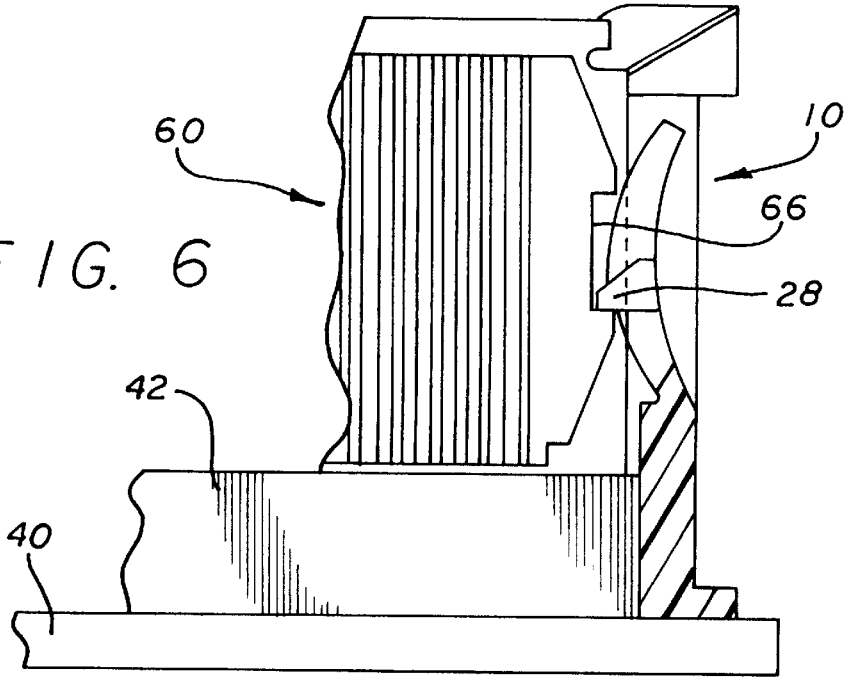
FIG. 6 is a perspective view showing the SEPP subassembly secured by a retention mechanism.

FIG. 5 shows another type of electronic subassembly 60 that can be plugged into the motherboard connector 42 and secured by a pair of retention mechanisms 10. The subassembly 60 may have a heat sink 62 coupled to a printed circuit board 64. By way of example, the subassembly 60 may be a product sold by Intel Corp. and referred to as a single edge processor package (SEPP). The SEPP subassembly 60 may contain a microprocessor. The heat sink 62 of the SEPP subassembly 60 has a notch 66.

The SEPP subassembly 60 can be mated to the motherboard connector 42 by sliding the edges of the printed circuit board 64 along the slots 24 in the retention mechanisms 10. The outer edge 68 of the heat sink 62 slides into channel 24 until the latches 28 snap into the notches 66 as shown in FIG.

6. The insertion of the subassembly 60 may also deflect the spring portions 26 to create corresponding spring force on the edges 68 of the heat sink 62. The SEPP subassembly 60 can be removed by pulling the latches 28 out of the notches and then lifting the subassembly 60 out of the connector 42.

The retention mechanism 10 of the present invention provides an apparatus that can retain both a SECC type subassembly and a SEPP type subassembly without modifying either subassembly. Providing a common retention mechanism can reduce the cost of producing, storing and selling components of the computer system.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A retention mechanism comprising:

a rear wall;

a pair of side walls connected to the rear wall and forming a guide to receive an electronic subassembly;

a spring portion formed within said rear wall, capable of flexing independently of said rear wall, protruding into the a connection side of said rear wall, and adapted to apply a spring force to said electronic subassembly;

a first latch extending from an upper portion of said rear wall to provide a first vertical securing force to the electronic subassembly; and a second latch connected to said spring portion and capable of flexing independently of the first latch to provide a second vertical securing force.

2. The retention mechanism of claim 1, wherein said spring portion includes a tapered surface.

3. The retention mechanism of claim 1, wherein said side wall includes a nut retainer.

4. The retention mechanism of claim 1, wherein said spring portion forms a second guide that can receive the electronic subassembly.

5. An electronic assembly, comprising:

a substrate;

an electronic subassembly adapted to be coupled to said substrate;

a retention mechanism, formed by a rear wall and a pair of side walls, mounted to said substrate and adapted to receive said electronic subassembly, said retention mechanism further comprising:

a spring portion formed within said rear wall, capable of flexing independently of said rear wall, protruding into the connection side of said rear wall, and adapted to apply a spring force to said electronic subassembly;

a first latch extending from an upper portion of said rear wall to provide a first securing force to the electronic subassembly; and a second latch connected to said spring portion and capable of flexing independently of the first latch to provide a second vertical securing force.

6. The assembly of claim 5, wherein said retention mechanism includes a nut retainer.

7. An electronic assembly, comprising:

a substrate;

an electronic subassembly adapted to be coupled to said substrate;

a heat sink with a notch attached to said electronic subassembly;

a retention mechanism, formed by a rear wall and two side walls, mounted to said substrate;

a first latch extending from the upper portion of said rear wall to provide a first vertical securing force to the electronic subassembly;

a spring portion formed within said rear wall, protruding into the connection side of said rear wall, and adapted to apply a spring force to the electronic subassembly; and, a second latch connected to said spring portion, capable of flexing independently of the first latch wall, and which couples with said notch in said heat sink attached to said electronic subassembly to provide a second vertical securing force.

8. The assembly of claim 7, wherein said retention mechanism includes a nut retainer.

9. The assembly of claim 7, wherein said spring portion describes a guide that can receive said electronic subassembly.

* * * * *

UNITED STATES PATENT AND TRADEMARK OFFICE

CERTIFICATE OF CORRECTION

PATENT NO. : 6,159,031
DATED : December 12, 2000
INVENTOR(S) : Llapitan et al.

It is certified that error appears in the above-identified patent and that said Letters Patent is hereby corrected as shown below:

Column 3,
Line 27, delete “the a connection” and insert -- the connection --.

Signed and Sealed this

Fourth Day of June, 2002

*Attest:*

*Attesting Officer*

JAMES E. ROGAN
*Director of the United States Patent and Trademark Office*